US009958119B2

(12) United States Patent
Baright

(10) Patent No.: US 9,958,119 B2
(45) **Date of Patent: *May 1, 2018**

(54) LIGHTING DEVICE AND SYSTEM

(71) Applicant: G&G LED, Red Hook, NY (US)

(72) Inventor: Jason Baright, Red Hook, NY (US)

(73) Assignee: G&G LED, LLC, Clifton Park, NY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/095,410

(22) Filed: Apr. 11, 2016

(65) Prior Publication Data

US 2016/0223152 A1 Aug. 4, 2016

Related U.S. Application Data

(63) Continuation of application No. 14/673,830, filed on Mar. 30, 2015, now Pat. No. 9,337,598, and a continuation-in-part of application No. 14/222,572, filed on Mar. 21, 2014.

(51) Int. Cl.

| | |
|---|---|
| ***F21S 4/28*** | (2016.01) |
| ***H01R 33/76*** | (2006.01) |
| ***F21V 23/06*** | (2006.01) |
| ***F21S 2/00*** | (2016.01) |
| ***F21V 21/005*** | (2006.01) |
| *F21V 3/02* | (2006.01) |
| *F21V 19/00* | (2006.01) |
| *F21Y 103/10* | (2016.01) |
| *F21Y 115/10* | (2016.01) |

(52) U.S. Cl.
CPC . *F21S 4/28* (2016.01); *F21S 2/00* (2013.01); *F21V 19/003* (2013.01); *F21V 21/005* (2013.01); *F21V 23/06* (2013.01); *H01R 33/76* (2013.01); *F21V 3/02* (2013.01); *F21V 19/004* (2013.01); *F21Y 2103/10* (2016.08); *F21Y 2115/10* (2016.08)

(58) Field of Classification Search
CPC ..... F21S 4/28; F21V 19/003; F21V 21/005; F21V 23/06
See application file for complete search history.

(56) References Cited

U.S. PATENT DOCUMENTS

| | | | | |
|---|---|---|---|---|
| 5,751,117 | A | 5/1998 | Abbott | |
| 6,100,644 | A | 8/2000 | Titus | |
| 7,611,260 | B1 | 11/2009 | Lin et al. | |
| 7,815,338 | B2 | 10/2010 | Siemiet et al. | |
| 7,997,770 | B1 | 8/2011 | Meurer | |
| 8,011,805 | B2 | 9/2011 | Chiang | |
| 8,147,091 | B2 * | 4/2012 | Hsia | F21V 25/04 362/218 |
| 8,235,545 | B2 | 8/2012 | Zheng et al. | |

(Continued)

*Primary Examiner* — Mary Ellen Bowman
(74) *Attorney, Agent, or Firm* — Hoffman Warnick LLC

(57) ABSTRACT

Embodiments of the invention relate generally to lighting devices and, more particularly, to elongate lighting devices having components adapted for interconnection, as well as lighting systems including such lighting devices. In one embodiment, the invention provides a lighting device comprising: an elongate housing; at least one light-emitting device within the housing; and a first connection device at a first end of the elongate housing, the first connection device being electrically connected to the at least one light-emitting device.

14 Claims, 8 Drawing Sheets

(56) References Cited

U.S. PATENT DOCUMENTS

| | | | |
|---|---|---|---|
| 8,251,544 | B2 | 8/2012 | Ivey et al. |
| 8,330,362 | B2 | 12/2012 | Lin |
| 8,388,172 | B2 | 3/2013 | Yue et al. |
| 8,398,260 | B2 | 3/2013 | Fan |
| 8,444,292 | B2 | 5/2013 | Ivey et al. |
| 8,567,986 | B2 | 10/2013 | Szprengiel et al. |
| 8,653,984 | B2 | 2/2014 | Ivey et al. |
| 2010/0033964 | A1 | 2/2010 | Choi et al. |
| 2010/0321921 | A1 | 12/2010 | Ivey |
| 2011/0176298 | A1 | 7/2011 | Meurer et al. |
| 2011/0309745 | A1 | 12/2011 | Westermarck et al. |
| 2012/0008315 | A1 | 1/2012 | Simon et al. |
| 2012/0051039 | A1 | 5/2012 | Chang |
| 2012/0212950 | A1 | 8/2012 | Wei |
| 2012/0243217 | A1 | 9/2012 | Szprengiel et al. |
| 2012/0275154 | A1 | 11/2012 | Hood et al. |
| 2012/0300446 | A1 | 11/2012 | Kim et al. |
| 2013/0050999 | A1 | 2/2013 | Simon |
| 2015/0267899 | A1 | 9/2015 | Baright |

* cited by examiner

LIGHTING DEVICE AND SYSTEM

CROSS-REFERENCE TO RELATED APPLICATIONS

This application is a continuation of co-pending U.S. patent application Ser. No. 14/673,830, filed 30 Mar. 2015, and a continuation-in-part of co-pending U.S. patent application Ser. No. 14,222,572, filed 21 Mar. 2014, each of which is incorporated herein as though fully set forth.

BACKGROUND OF THE INVENTION

Embodiments of the invention relate generally to lighting devices and, more particularly, to elongate lighting devices having components adapted for interconnection, as well as lighting systems including such lighting devices.

BRIEF DESCRIPTION OF THE INVENTION

In one embodiment, the invention provides a lighting device comprising: an elongate housing; at least one light-emitting device within the housing; and a first connection device at a first end of the elongate housing, the first connection device being electrically connected to the at least one light-emitting device.

In another embodiment, the invention provides a lighting system comprising: a first lighting device comprising: an elongate housing; at least one light-emitting device within the housing; a first connection device at a first end of the elongate housing, the first connection device being electrically connected to the at least one light-emitting device; and a second connection device at a second end of the elongate housing, the second connection device being electrically connected to the first connection device; a second lighting device comprising: an elongate housing; at least one light-emitting device within the housing; and a first connection device at a first end of the elongate housing, the first connection device being electrically connected to the at least one light-emitting device; an electrical supply device adapted for connection and supplying an electrical current to the first connection device of the first lighting device; and a jumper device for connection to the second connection device of the first lighting device and the first connection device of the second lighting device, wherein the electrical current supplied to the first connection device of the first lighting device is delivered to the second lighting device via the jumper device.

In yet another embodiment, the invention provides a lighting system comprising: a first lighting device comprising: a first elongate housing; at least one first light-emitting device within the first elongate housing; a first connection device at a first end of the first elongate housing, the first connection device being electrically connected to the at least one first light-emitting device; and a second connection device at a second end of the first elongate housing, the second connection device being electrically connected to the first connection device; a second lighting device comprising: a second elongate housing; at least one second light-emitting device within the second elongate housing; and a third connection device at a first end of the second elongate housing, the third connection device being adapted for electrical connection to the second connection device and the at least one second light-emitting device; and an electrical supply device adapted for supplying an electrical current to the first connection device and, when the third connection device is connected to the first connection device, to the third connection device.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements among the drawings.

DETAILED DESCRIPTION OF THE INVENTION

Figure 1:
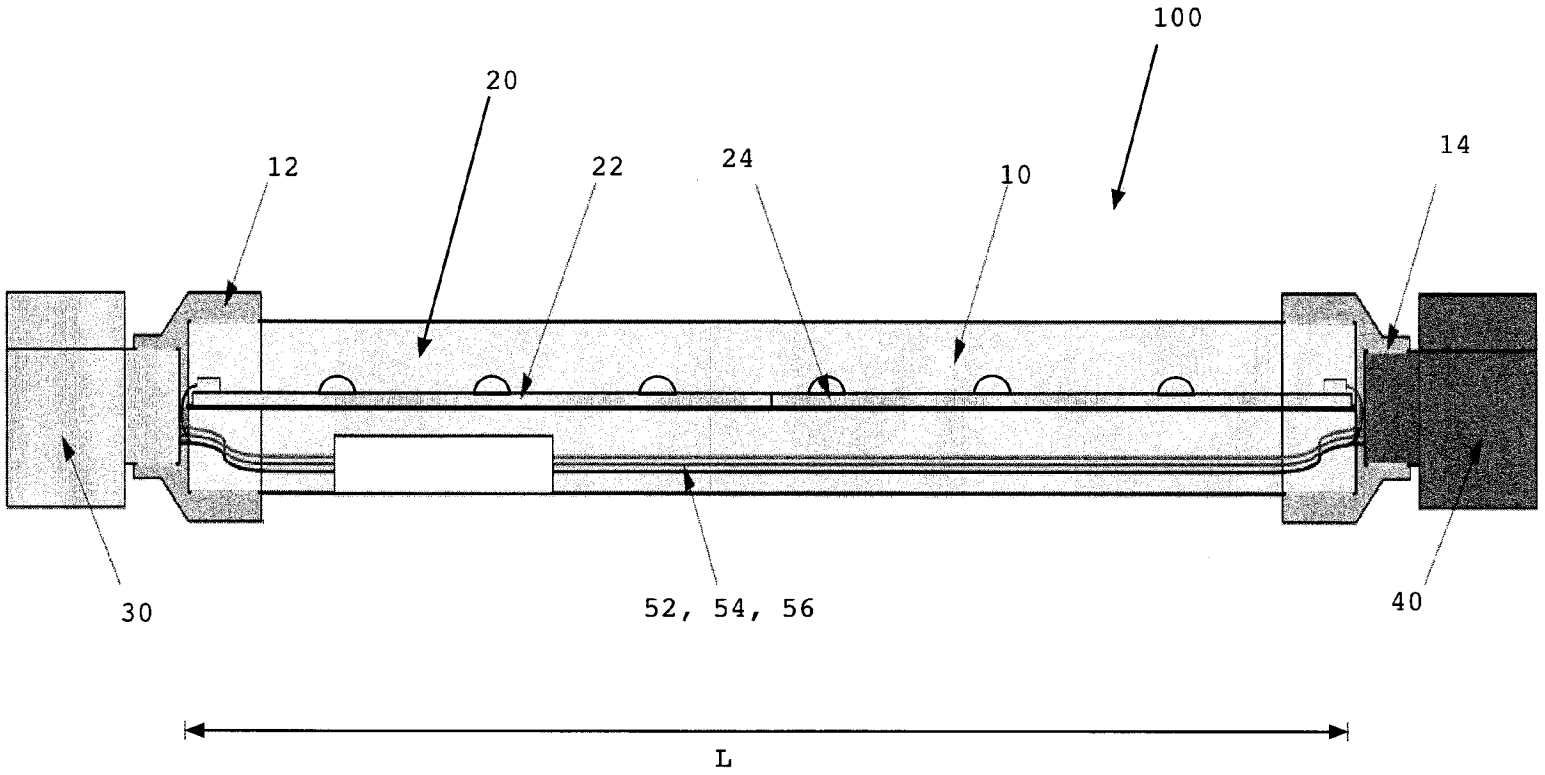
FIG. 1 shows a side view of a lighting device according to an embodiment of the invention.

Referring now to the drawings, FIG. 1 shows a cross-sectional side view of a lighting device 100 according to one embodiment of the invention. Lighting device 100 includes an elongate housing ("housing") 10 containing a light-emitting device 20. In the embodiment shown in FIG. 1, light-emitting device 20 includes a circuit board 22 having a plurality of light-emitting diodes (LEDs) 24 disposed along its length. This is neither necessary nor essential, however, and other light-emitting devices may be employed, as would be recognized by one of ordinary skill in the art. Similarly, various methods and techniques for physically and electrically connecting LEDs 24 to circuit board 22 are known in the art and would be apparent to one skilled in the art. Such methods and techniques will not be described here, merely for the sake of brevity.

Housing 10 may take any number of cross-sectional shapes. According to some embodiments of the invention, housing 10 is substantially circular in cross-sectional shape. Housing 10 may similarly be formed from or include any number of materials. At least a portion of housing 10 is comprised of transparent or semi-transparent materials in order to allow illumination by LEDs 24. Suitable materials for housing 10 therefore include, for example, polycarbonates, acrylics, copolyesters, and glasses. Housing may include, as a coating or an integrated material, a UV-resistant material and/or a material capable of diffusing light produced by LEDs 24.

Lighting device 100 further includes a first connection device 30 at a first end 12 of housing 10 and a second connection device 40 at a second end 14 of housing 10. As will be explained in greater detail below, first connection device 30 is electrically connected to light-emitting device 20 and is operable to deliver an electrical current from an electrical supply to light-emitting device 20. Similarly, second connection device 40 is electrically connected to at least one of first connection device 30 or light-emitting device 20 such that an electrical current may be delivered from an electrical supply to second connection device 40, which in turn may be electrically connected to a first connection device of an adjacent lighting device, thereby delivering an electrical current to the adjacent lighting device.

FIG. 1 shows power lines 52, 54 and a control line 56 extending through housing 10 between first connection device 30 and second connection device 40 and electrically connected to circuit board 22. These features will be described further below with respect to FIG. 3.

As shown in FIG. 1, housing 10 has a length L, generally defined as a portion of housing 10 between first and second connection devices 30, 40 and through which light is emitted by light-emitting device 20. Length L may vary according to various embodiments of the invention. In some embodiments, length L is about four feet, although both shorter (e.g., two feet, one foot, etc.) and longer (e.g., six feet, eight feet, etc.) are possible.

Regardless of length, embodiments of the invention have been found to exhibit greater power density, greater power efficiency, and greater beam angle than previously known devices. For example, devices according to the invention, regardless of length L of housing 10, have been found to have power densities of about 1000 lumens/ft or greater. Power densities as high as 2000 lumens/ft have been achieved using embodiments of the invention.

With respect to power efficiency, lighting devices according to various embodiments of the invention are capable of producing over 110 lumens/watt. This is a significant increase over typical devices, which exhibit power efficiencies less than 100 lumens/watt, often less than 90 lumens/watt.

As to beam angle, known devices are typically capable of producing a relatively narrow half-peak beam angle of 60 degrees or less and are therefore not suitable for broad illumination of an area unless a number of such devices are employed, each angled differently from the other. Lighting devices according to embodiments of the invention, however, are capable of producing wide half-peak beam angle of over 90 degrees, providing illumination over a broad area from a single lighting device.

Figure 2:
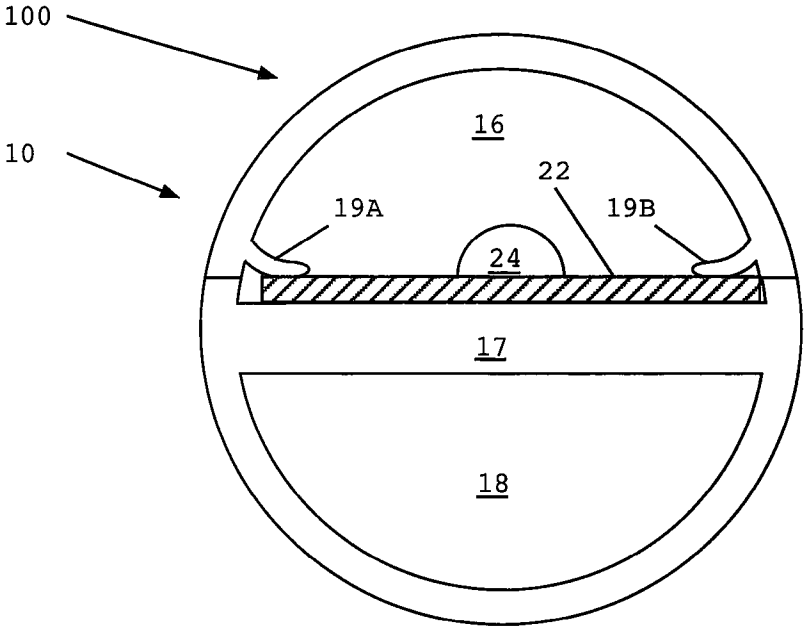
FIG. 2 shows a cross-sectional view of a lighting device according to an embodiment of the invention.

FIG. 2 shows a cross-sectional view of lighting device 100 according to one embodiment of the invention. As can be seen, housing 10 has a substantially circular cross-sectional shape. A circuit board 22 containing LED 24 is held in place within housing 10 between a support shelf 17 extending across an interior of housing 10 and a pair of restraining members 19A, 19B. That is, restraining members 19A, 19B act to exert a downward force upon circuit board 22, ensuring maintenance of contact between circuit board 22 and support shelf 17. While only one LED is shown, one skilled in the art will recognize that a plurality of LEDs may extend along a length of circuit board 22, as shown, for example, in FIG. 1.

Support shelf 17 further acts to divide an interior of housing 10 into an first cavity 16 and a second cavity 18. Second cavity 18 may be employed, for example, as a conduit raceway, with one or more channels (not shown) connecting first cavity 16 and second cavity 18 along the length L of housing 10.

The arrangement shown in FIG. 2 is illustrative of the various embodiments and configurations encompassed by the invention and is not intended to limit the scope of the invention. Other arrangements and configurations are described, for example, in U.S. patent application Ser. No. 14/222,572, filed 21 Mar. 2014, which is hereby incorporated herein for all that it contains as though fully set forth.

Figure 3:
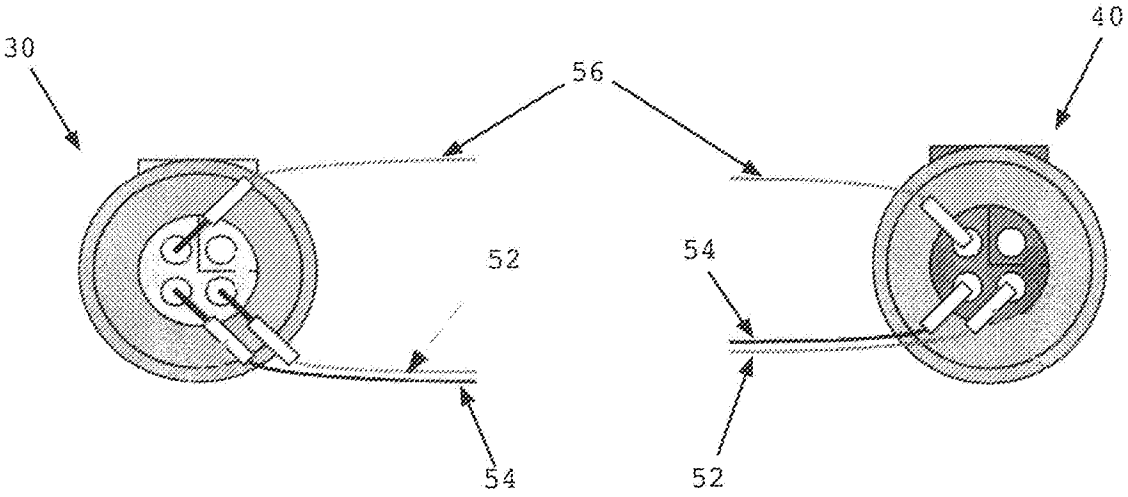
FIG. 3 shows internal views of portions of a connection device according to an embodiment of the invention.

FIG. 3 shows outwardly facing views (i.e., as seen from inside housing 10) of first connection device 30 and second connection device 40. Each of first and second connection devices 30, 40 include wiring connections, including connections for power lines 52, 54, and optionally, a control line 56. Control line 56 may be employed for any number of functions, including, for example, dimming LEDs 24 or changing a color of LEDs. Other control functions will be apparent to one skilled in the art and are intended to fall within the scope of the invention.

Figure 4:
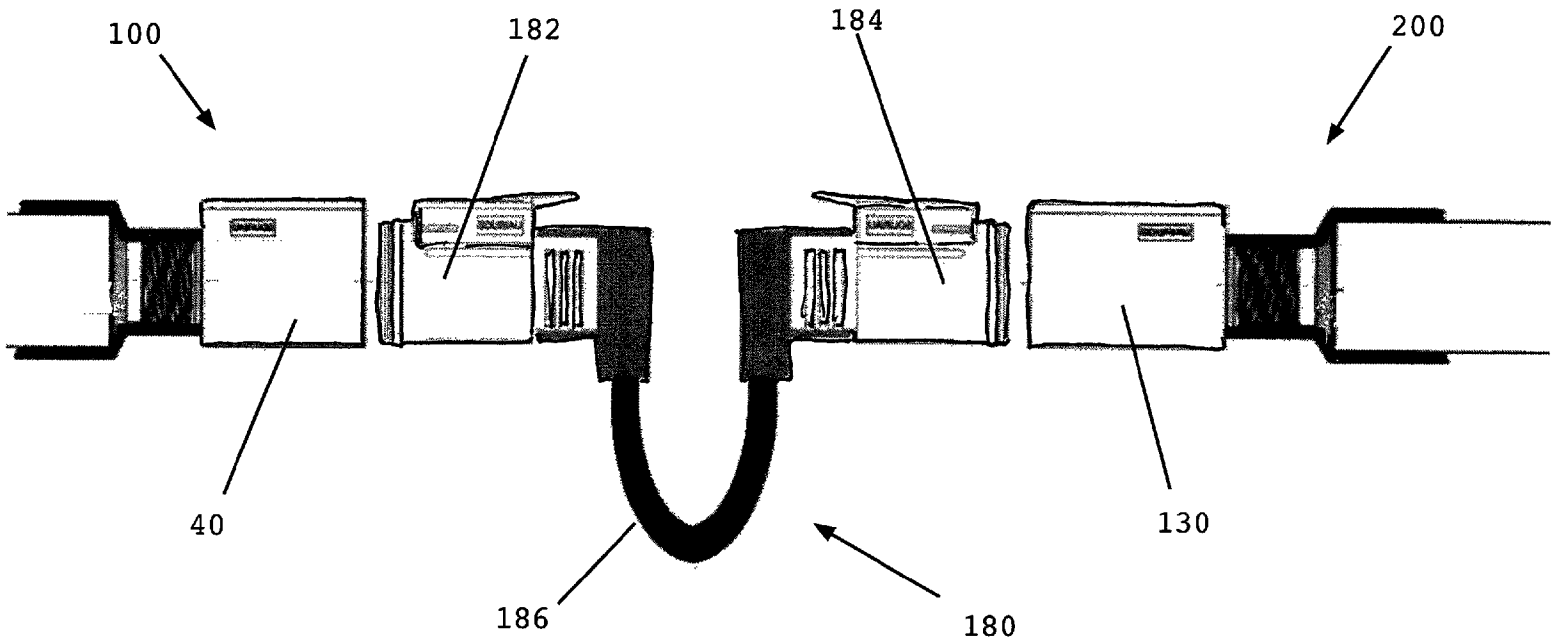
FIG. 4 shows a side view of portions of two lighting devices connected according to an embodiment of the invention.

FIG. 4 shows a side view of a jumper device 180 for connecting a second connection device 30 of a first lighting device 100 and a first connection device 130 of a second lighting device 200 in a daisy-chained manner. As will be apparent to one skilled in the art, jumper device 180 includes a first plug 182 adapted to be physically and electrically connected to second connection device 40 and a second plug 184 adapted to be physically and electrically connected to first connection device 130, with an electrical cable 186 disposed therebetween. In this manner, electrical current, grounding, and control functions may be extended from first lighting device 100 to second lighting device 200, such that first and second lighting devices 100, 200 may function in combination.

It should be noted that the first and second plugs 182, 184 shown in FIG. 4 are merely illustrative of the types of devices that might be employed in practicing the invention. One skilled in the art will recognize that any number of devices may be employed in making connections such as those shown in FIG. 4, including those devices employing push-and-click mechanisms, friction fittings, magnets, threads, etc. Connection devices will, of course, be chosen based on their appropriateness for the particular environment in which the lighting devices of the invention will be employed. For example, in exposed or wet environments, the connection devices used should prevent or resist the incursion of water or other materials from the environment. To this end, such devices may include, for example, gaskets, o-rings, or similar components adapted or designed to prevent such incursion.

Figure 5:
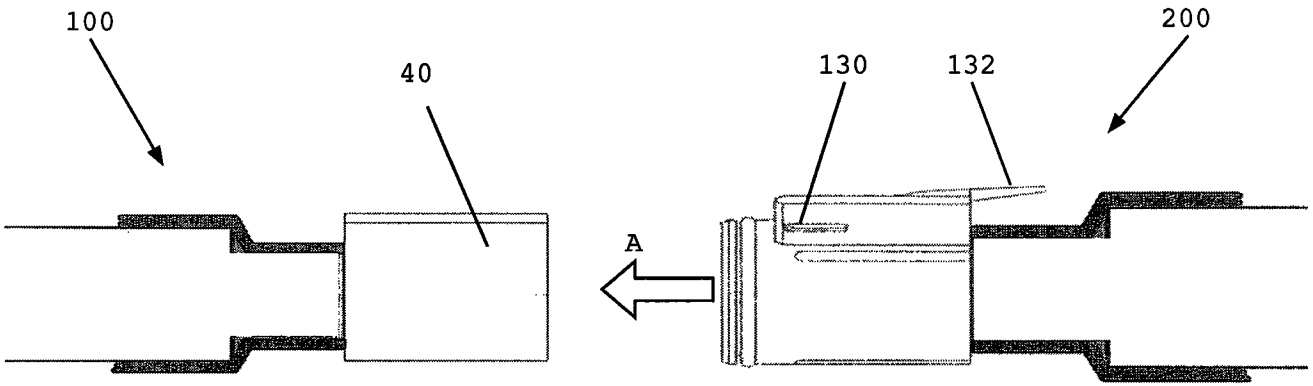
FIG. 5 shows a side view of portions of two lighting devices connected according to another embodiment of the invention.

FIG. 5 shows a first lighting device 100 and second lighting device 200 connected according to another embodiment of the invention. Here, rather than employing a jumper device as in FIG. 4, first and second lighting devices 100, 200 may be directly connected, physically and electrically. Specifically, first connection device 130 of second lighting device 200 may be inserted into second connection device 40 of first lighting device 100 along path A. First connection device 130 may employ, for example, a locking mechanism 132 or similar device for retaining a portion of first connection device 130 within second connection device 40, as will be apparent to one skilled in the art. As will similarly be understood by one skilled in the art, locking mechanism 132 may include any number of features and operate according to any number of methods, including those described above with respect to first and second plugs 182, 184 of jumper device 180.

Figure 6:
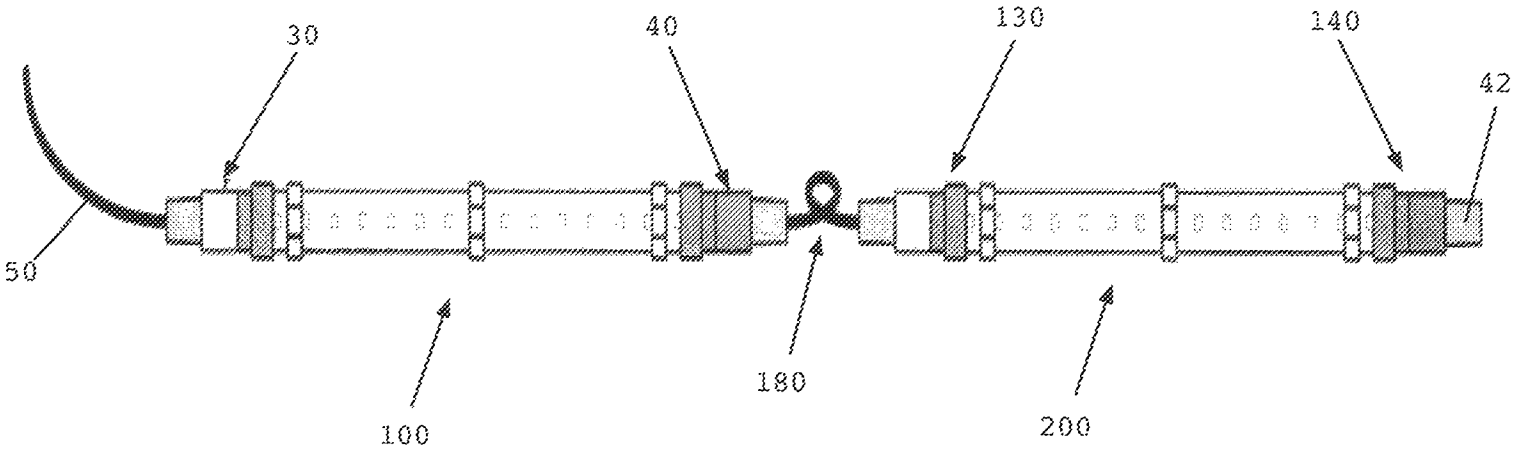
FIG. 6 shows a side view of two lighting devices connected according to an embodiment of the invention.

FIG. 6 shows a pair of connected lighting devices 100, 200 according to an embodiment of the invention. As shown in FIG. 6, first connection device 30 of first lighting device 100 is physically and electrically connected to a lead 50, which provides electrical current from a power source (not shown, described below). Lead 50 may be connected to first connection device 30 in a manner similar to the connection of jumper device 180 (FIG. 4) to first or second ends 30, 140 (FIG. 4) as described above.

A jumper device 180 connects a second connection device 40 of first lighting device 100 to a first connection device 130 of second lighting device 200 in any manner similar to that described above with respect to FIG. 4. In addition, in circumstances where second lighting device 200 is the last lighting device in a string of connected lighting device, a plug device 42 may be inserted into second connection device 140 of second lighting device 200.

Figure 8:
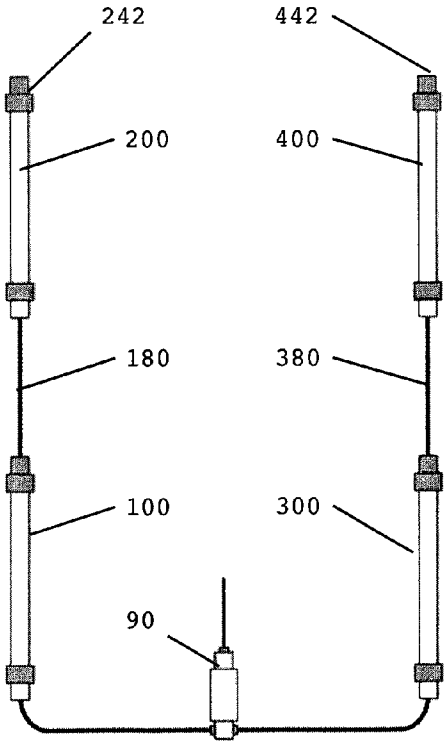
FIGS. 7 and 8 show schematic views of pluralities of lighting devices connected according to various embodiments of the invention.
Figure 7:
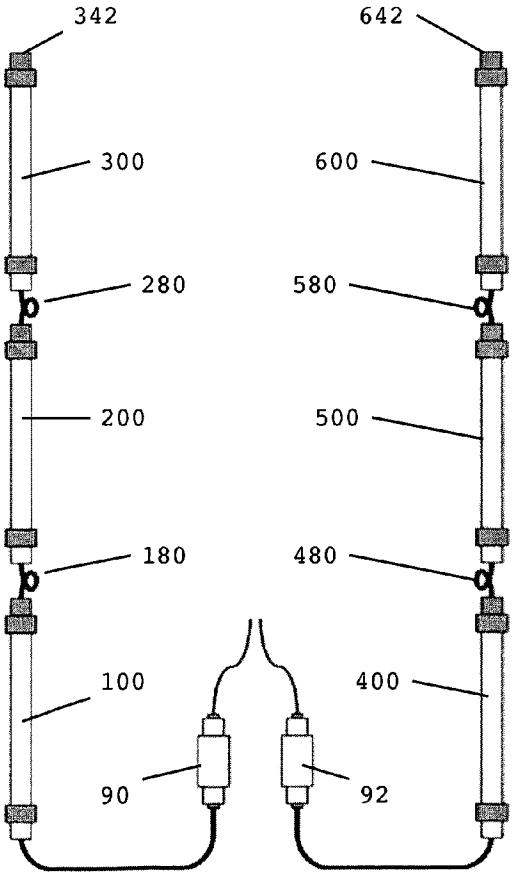

FIGS. 7 and 8 show various configurations of pluralities of lighting devices according to embodiments of the invention. In FIG. 7, a total of six lighting devices 100, 200, 300, 400, 500, 600 are connected to one of two power supplies 90, 92. Power supplies 90, 92 may be, for example, AC to DC converters, as will be understood by one skilled in the art. As shown in FIG. 7, lighting devices 100, 200, and 300 are connected in series to a first power supply 90, while lighting devices 400, 500, and 600 are connected in series to a second power supply 92. Power supplies 90, 92 may themselves be connected to the same or different power sources (not shown), such as an AC circuit.

In FIG. 8, lighting devices 100 and 200 are connected in series, as are lighting devices 300 and 400. These two groups of lighting devices, however, are connected in parallel to power supply 90. One skilled in the art will recognize the advantages of series and parallel connection of lighting devices with respect to resistance, etc., and would be capable of determining an appropriate configuration for any particular lighting application. The configurations shown in FIGS. 7 and 8 are therefore intended merely as illustrative examples and are not intended to limit the scope of the invention in any way.

Figure 9:
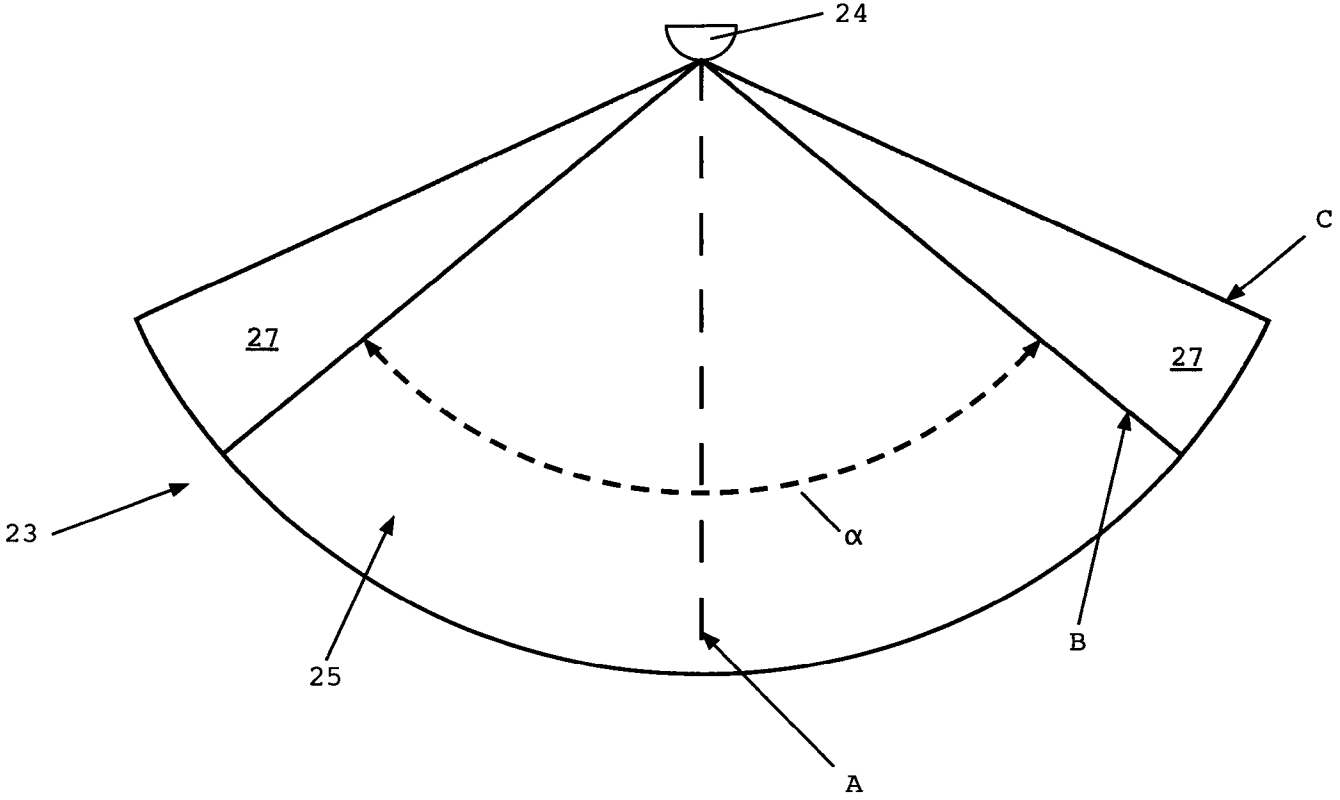
FIG. 9 shows a schematic of a beam angle of a lighting device according to an embodiment of the invention.

FIG. 9 shows a graphical representation of a beam angle achievable according to an embodiment of the invention. As can be seen, LED 24, such as may be included along a circuit board of a lighting device according to embodiments of the invention, emits an area of illumination 23 comprising a first portion 25 and a second portion 27. First portion includes a beam angle $\alpha$ of about 100 degrees. Beam angle $\alpha$ is typically referred to as a half-peak beam angle, where the peak illumination (as may be measured in candlepower) observed at A is reduced to approximately half at B. Second portion 27 may be referred to as an area of spill light. Here, illumination ranges from about half peak at B to about 10 percent of peak at C.

As noted above, lighting devices according to embodiments of the invention are capable of producing wide half-peak beam angle $\alpha$ of over 90 degrees, e.g., about 100 degrees. This provides illumination over a broader area from a single lighting device than is possible with known lighting devices.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting system comprising:
a first lighting device comprising:
an elongate housing having:
a support shelf extending across an interior of the elongate housing to support a circuit board; and
a circuit board restraining member for restraining the circuit board against the support shelf;
at least one light-emitting device within the housing;
a first connection device at a first end of the elongate housing, the first connection device being electrically connected to the at least one light-emitting device; and
a second connection device at a second end of the elongate housing, the second connection device being electrically connected to the first connection device;
a second lighting device comprising:
an elongate housing having:
a support shelf extending across an interior of the elongate housing to support a circuit board; and
a circuit board restraining member for restraining the circuit board against the support shelf;
at least one light-emitting device within the housing;
a third connection device at a first end of the elongate housing, the third connection device being electrically connected to at least one of the first connection device or the second connection device,
wherein an electrical current supplied to the first connection device of the first lighting device is delivered to the second lighting device via the third connection device.

2. The lighting system of claim 1, wherein the at least one light-emitting device of each of the first and second lighting devices includes a plurality of light-emitting diodes (LEDs) disposed along a circuit board within the housing.

3. The lighting system of claim 2, wherein the plurality of LEDs have a power density of at least about 1000 lumens/ft.

4. The lighting system of claim 2, wherein the plurality of LEDs have a beam angle of greater than 90 degrees.

5. The lighting system of claim 1, further comprising:
an electrical supply device for supplying the electrical current to the first connection device.

6. The lighting system of claim 1, wherein the elongate housing of each of the first and second lighting devices is at least about two feet long and the at least one light-emitting device of each of the first and second lighting devices includes a plurality of light-emitting devices disposed within and along a length of the elongate housing.

7. The lighting system of claim 6, wherein the elongate housing of each of the first and second lighting devices is between about four feet and about eight feet long.

8. A lighting system comprising:
a first lighting device comprising:
an elongate housing;
at least one light-emitting device within the housing;
a first connection device at a first end of the elongate housing, the first connection device being electrically connected to the at least one light-emitting device; and
a second connection device at a second end of the elongate housing, the second connection device being electrically connected to the first connection device;

a second lighting device comprising:

an elongate housing;

at least one light-emitting device within the housing;

a third connection device at a first end of the elongate housing, the third connection device being electrically connected to at least one of the first connection device or the second connection device, wherein an electrical current supplied to the first connection device of the first lighting device is delivered to the second lighting device via the third connection device.

9. The lighting system of claim 8, wherein the at least one light-emitting device of each of the first and second lighting devices includes a plurality of light-emitting diodes (LEDs) disposed along a circuit board within the housing.

10. The lighting system of claim 9, wherein the plurality of LEDs have a power density of at least about 1000 lumens/ft.

11. The lighting system of claim 9, wherein the plurality of LEDs have a beam angle of greater than 90 degrees.

12. The lighting system of claim 8, further comprising:

an electrical supply device for supplying the electrical current to the first connection device.

13. The lighting system of claim 8, wherein the elongate housing of each of the first and second lighting devices is at least about two feet long and the at least one light-emitting device of each of the first and second lighting devices includes a plurality of light-emitting devices disposed within and along a length of the elongate housing.

14. The lighting system of claim 13, wherein the elongate housing of each of the first and second lighting devices is between about four feet and about eight feet long.

* * * * *